United States Patent [19]

Munekawa et al.

[11] Patent Number: 5,076,351

[45] Date of Patent: Dec. 31, 1991

[54] HEAT PIPE

[75] Inventors: Masaaki Munekawa, Ibaraki; Chuichi Takahashi, Tochigi; Kaoru Hasegawa, Tochigi; Koichiro Fukui, Tochigi; Yuichi Furukawa, Tochigi, all of Japan

[73] Assignee: Showa Aluminum Corporation, Sakai, Japan

[21] Appl. No.: 553,297

[22] Filed: Jul. 17, 1990

[30] Foreign Application Priority Data

Jul. 19, 1989 [JP] Japan ..... 1-187651
Nov. 2, 1989 [JP] Japan ..... 1-286995

[51] Int. Cl.[5] ..... F28D 15/02

[52] U.S. Cl. ..... 165/104.21; 165/104.14; 165/104.31; 361/385

[58] Field of Search ..... 165/104.21, 104.14, 165/104.33; 361/385

[56] References Cited

U.S. PATENT DOCUMENTS

| | | | |
|---|---|---|---|
| 3,143,592 | 8/1964 | August | 165/104.21 |
| 3,564,727 | 2/1971 | Fraser | 165/104.21 |
| 3,914,957 | 10/1975 | Jacobs | 165/104.21 |
| 4,140,103 | 2/1979 | Leigh | 165/104.21 |
| 4,393,922 | 7/1983 | Bahrle et al. | 165/104.21 |
| 4,588,023 | 5/1986 | Munekawa | 165/104.21 |
| 4,830,100 | 5/1989 | Kato | 165/104.14 |

*Primary Examiner*—Albert W. Davis, Jr.
*Attorney, Agent, or Firm*—Armstrong, Nikaido, Marmelstein, Kubovcik & Murray

[57] ABSTRACT

In a heat pipe container having a working fluid enclosed therein, the container includes a container body in the form of a horizontal straight tube and having an evaporator portion, a heat insulating portion and a condenser portion as arranged from one end of the body to the other end thereof, and an upward hollow projecting portion provided on the condenser portion of the container body.

4 Claims, 16 Drawing Sheets

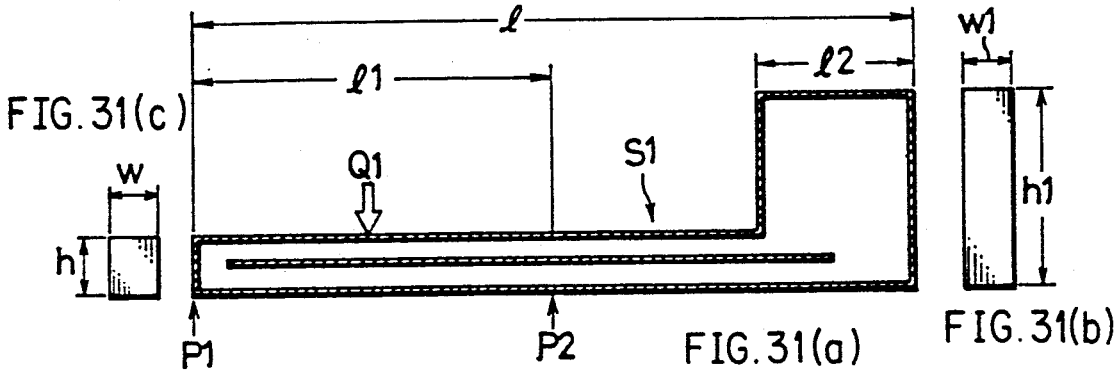
FIG. 31(c)
FIG. 31(a)
FIG. 31(b)
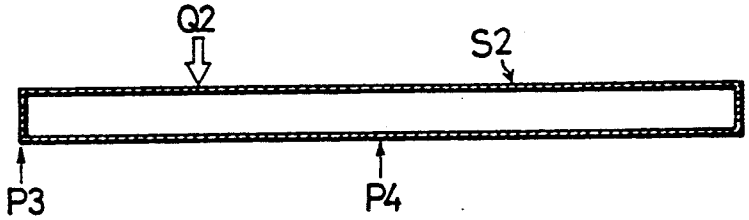
FIG. 32
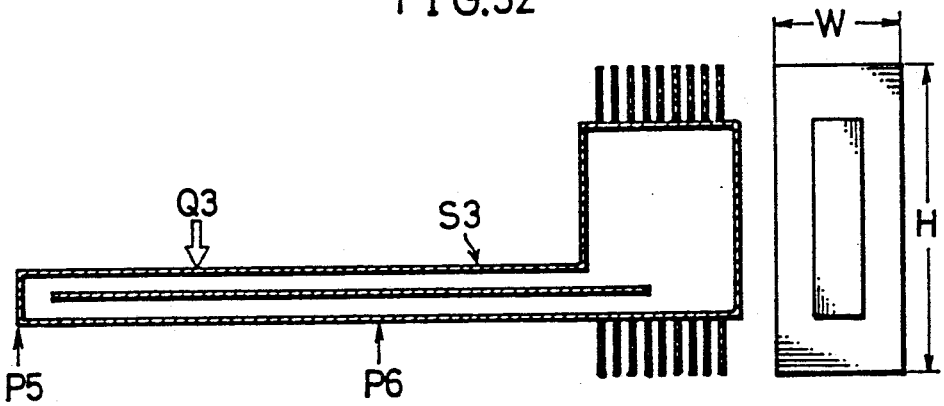
FIG. 33(a)
FIG. 33(b)
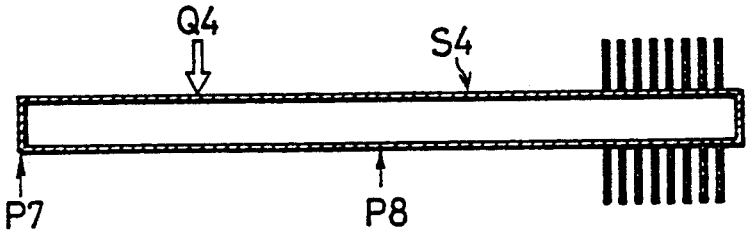
FIG. 34

HEAT PIPE

BACKGROUND OF THE INVENTION

The present invention relates to heat pipes for use in releasing heat from heat evolving bodies in audio systems, copying machines, computers, etc.

Heat pipes heretofore known include those of the straight tubular type which comprise a container in the form of a straight tube and having water, Freon or like working fluid enclosed therein.

The performance of heat pipes (i.e.) the amount of heat transport, varies according to various factors, which include the kind of working fluid, the compatibility of the working fluid with the material of the container, the diameter of the container, the temperature of the heat insulating portion, the inclination of the heat pipe, presence or absence of a wick or groove, etc. Of these factors, the inclination of the heat pipe greatly influences the amount of heat transport as shown in FIG. 35 and FIG. 36. Especially small variations in the inclination of the heat pipe as positioned nearly horizontally greatly alter the amount of heat transport. Further as shown in FIG. 37, the amount of heat transport also changes greatly with the diameter of the container.

Audio devices and the like must essentially be lightweight and compact, and the container therefore needs to be reduced in both diameter and length. This presents difficulty in ensuring the required amount of heat transport. Furthermore, the heat pipe for use in such devices must generally be installed horizontally. This is also a great factor in causing a reduced amount of heat transport. Moreover, the amount of heat transport is greater when the working fluid is water than when it is Freon as will be apparent from FIGS. 35 and 36, so that water is used as the working fluid in the case where the heat pipe is installed horizontally. It is then impossible to use aluminum as the material for the container, necessitating the use of copper for the container. This makes it difficult to reduce the weight of the heat pipe.

In the case where the straight tubular heat pipe is used in audio devices or the like, a heat evolving body is attached to one end of the pipe, and the other end thereof serves as a condenser portion. It is then difficult to design the heat pipe so as to be accommodated in the case of the device since the heat pipe needs an increased length.

SUMMARY OF THE INVENTION

The main object of the present invention is to provide a heat pipe which ensures transport of the required amount of heat even when installed in a horizontal position and which can nevertheless be made lightweight and compact.

The present invention provides a heat pipe including a container having a working fluid enclosed therein, the container comprising a container body in the form of a horizontal straight tube and having an evaporator portion, a heat insulating portion and a condenser portion as arranged from one end of the body to the other end thereof, and an upward hollow projecting portion provided on the condenser portion of the container body.

The present invention provides another heat pipe comprising a plurality of containers having a working fluid enclosed therein and arranged side by side, each of the containers being in communication with another container adjacent thereto, each of the containers comprising a container body in the form of a horizontal straight tube and having an evaporator portion, a heat insulating portion and a condenser portion as arranged from one end of the body to the other end thereof, and an upward hollow projecting portion provided on the condenser portion of the container body.

When the heat pipe of the present invention is in operation, the working fluid in the form of a gas is not only liquefied in the condenser portion of the container body but also flows from the condenser portion into the projecting portion, where the gaseous fluid is liquefied. Accordingly, the gaseous working fluid flows from the evaporator portion into the condenser portion smoothly, consequently transporting a larger amount of heat than in the case of the conventional straight tubular heat pipe. For transporting the same amount of heat as in the conventional heat pipe, the condenser portion can be shorter to make the heat pipe compact and lightweight. Moreover, heat can be transported in an amount not smaller than is the case with the conventional heat pipe of the straight tubular type even with use of Freon as the working fluid. The use of Freon permits the use of aluminum for the container to achieve a greater weight reduction.

A plurality of such heat pipes which are efficient and compact are arranged side by side to provide the heat pipe of the second type, which therefore achieves an extremely high efficiency and is compact.

BRIEF DESCRIPTION OF THE DRAWINGS

FIG. 1 is a perspective view partly broken away;

FIG. 2 is a longitudinal view in vertical section;

FIGS. 3 to 8 are perspective views corresponding to FIG. 1 and showing modified containers;

FIG. 9 is a perspective view;

FIG. 10 is an exploded perspective view of a container;

FIG. 11 is a perspective view showing a modified container;

FIG. 12 is a view in horizontal section taken along the line XII—XII in FIG. 11;

FIG. 13 is an enlarged view in vertical section taken along the line XIII—XIII in FIG. 11;

FIG. 14 is a perspective view showing another modified container;

FIG. 15 is a view in section taken along the line XV—XV in FIG. 14;

FIG. 16 is a side elevation showing a modified working fluid injection tube;

FIG. 17 is a view in section taken along the line XVI—XVI in FIG. 16;

FIG. 18 is a perspective view partly broken away;

FIG. 19 is a longitudinal view in vertical section taken along the line XIX—XIX in FIG. 18;

FIG. 20 is a longitudinal view in horizontal section taken along the line XX—XX in FIG. 18;

FIG. 21 is an enlarged view in vertical section taken along the line XXI—XXI in FIG. 19;

FIG. 22 is a side elevation showing a modified working fluid injection tube;

FIG. 23 is a view in section taken along the line XXIII—XXIII in FIG. 22;

FIG. 24 is a side elevation showing another modified working fluid injection tube;

FIG. 25 is a view in section taken along the line XXV—XXV in FIG. 24;

FIG. 26 is a perspective view;

FIG. 27 is a longitudinal view in vertical section taken along the line XXVII—XXVII in FIG. 26;

FIG. 28 is a view in horizontal section taken along the line XXVIII—XXVIII in FIG. 26;

FIG. 29 is an enlarged view in vertical section taken along the line XXIX—XXIX in FIG. 27;

FIG. 30 is an exploded perspective view of a container;

FIGS. 31 to 34 are diagrams for illustrating performance tests conducted for a comparison between conventional heat pipes and heat pipes of the present invention.

DESCRIPTION OF THE PREFERRED EMBODIMENTS

Embodiments of the present invention will be described below with reference to the drawings.

Embodiment 1

FIGS. 1 to 8 show heat pipes according to a first embodiment of the invention.

The heat pipe has a container 10, and a working fluid F enclosed in the container 10. A Freon is selected for use as the working fluid F.

Figure 1:
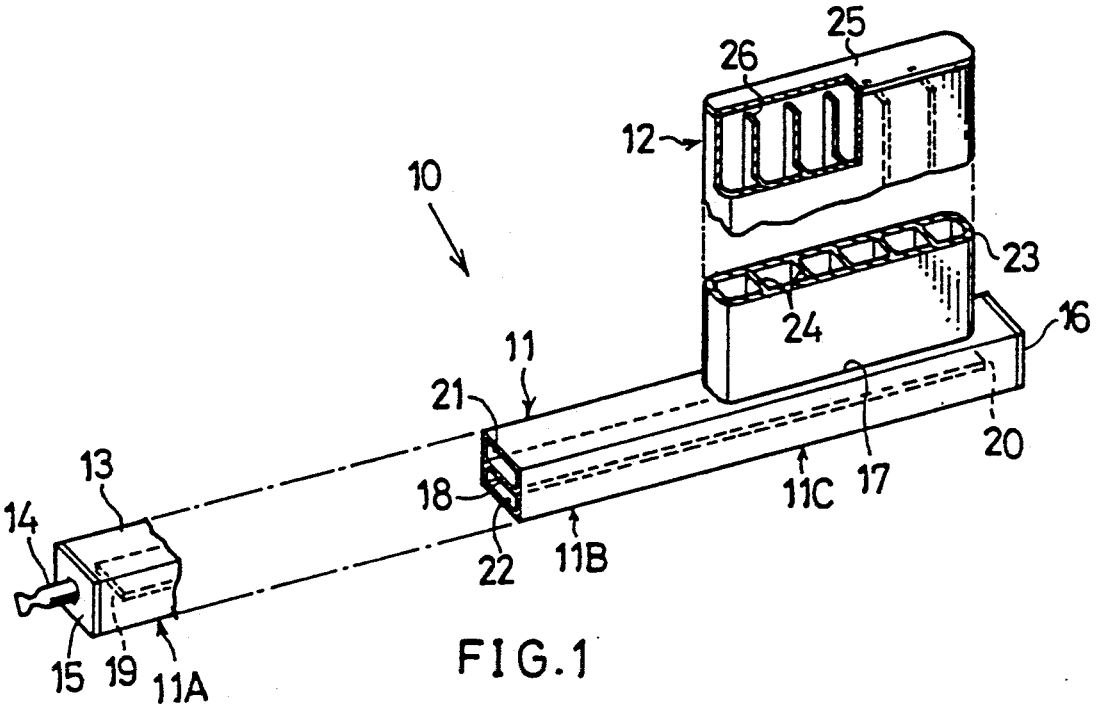
FIGS. 1 to 8 show heat pipes according to a first embodiment of the invention.
Figure 2:
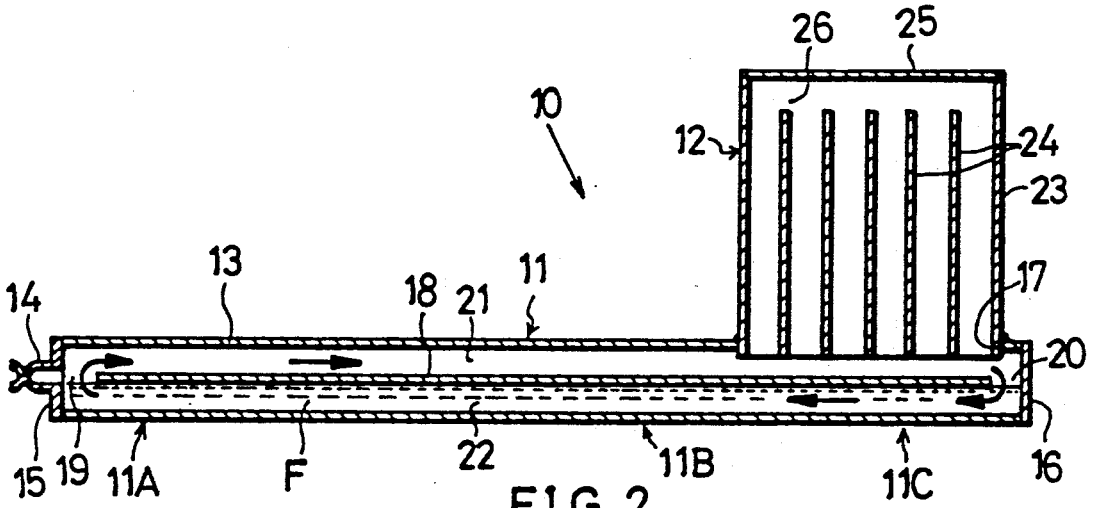

With reference to FIGS. 1 and 2, the container 10 comprises a container body 11 in the form of a horizontal straight tube and having an evaporator portion 11A, a heat insulating portion 11B and a condenser portion 11C as arranged from one end of the body 11 to the other end thereof, and an upward hollow projecting portion 12 provided on the condenser portion 11C. The container body 11 comprises a peripheral wall 13 in the form of a tube of rectangular cross section and made of an aluminum extrudate, a closure 15 having a working fluid injection tube 14 and provided at the evaporator end of the peripheral wall 13, and a closure 16 provided at the condenser end of the wall 13. A rectangular communication aperture 17 elongated along the peripheral wall 13 is formed in the top of the wall 13 at the condenser portion 11C. The peripheral wall 13 is internally provided with a horizontal partition 18 to provide working fluid passages 19, 20 at the respective ends thereof and to form a path in the form of a loop and including an upper channel 21 and a lower channel 22. The projecting portion 12 comprises a trunk wall 23 having a lower end fitted in the communication aperture 17 and joined to the container body 11, a plurality of vertical partition walls 24 arranged in parallel inside the trunk wall 23 longitudinally of the container body 11, and a top wall 25 provided at the upper end of the trunk wall 23. The trunk wall 23, as well as the partition walls 24, is made of a flat tube of aluminum extrudate. The end of the flat tube connected to the container body is intimately fitted in the communication aperture 17 and joined to the aperture-defining edge. The partition walls 24 are cut out at their upper ends as indicated at 26 to provide a working fluid passage.

The working fluid F is injected into the container 10 through the injection tube 14, which is thereafter closed by collapsing. When required, the container body 11 is internally provided with a wick or grooves.

When the evaporator portion 11A is heated, the working fluid is gasified at this portion, and the gaseous working fluid flows through the upper channel 21 into the condenser portion 11C, where the gas is partly liquefied on releasing heat. The remaining portion of the gas flows into the projecting portion 12, where the gas is also liquefied. The liquid working fluid returns to the evaporator portion 11A through the lower channel 22.

Since the working fluid flows through the looped path in one direction, the heat pipe achieves a high heat transfer efficiency without permitting a portion of the working fluid to collide with another portion thereof. Even if the heat pipe is inclined with the condensor portion 11C positioned at a slightly lower level than the evaporator portion 11A, the flow of the working fluid in one direction forces up the condensed liquid, thereby eliminating the likelihood of drying out.

Figure 3:
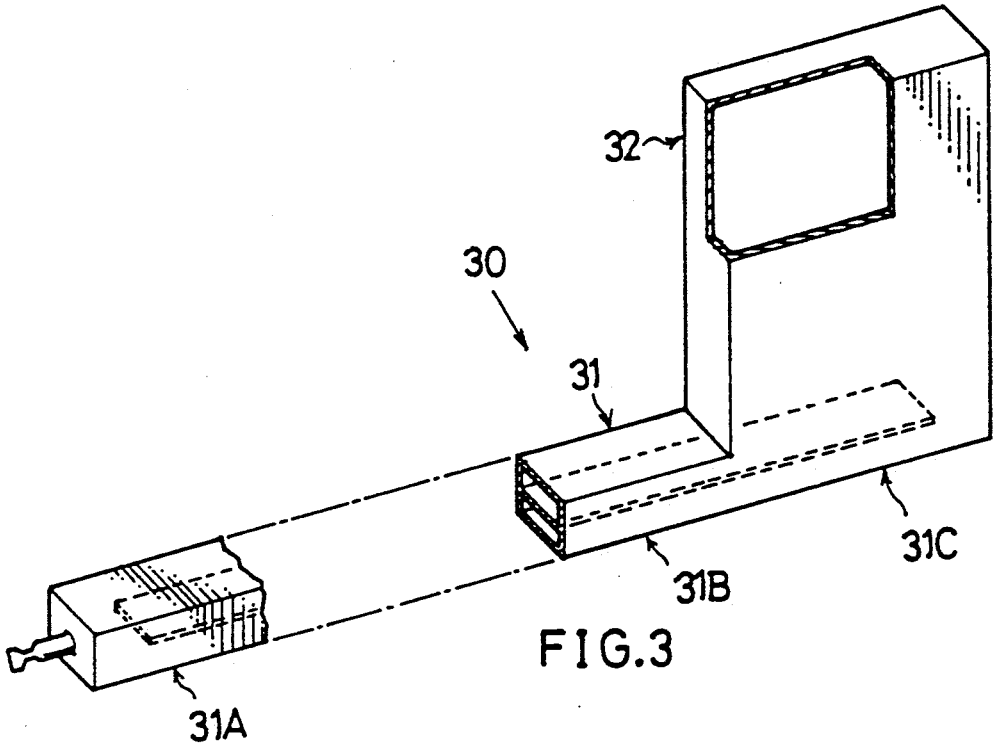

FIG. 3 shows a modified container 30, which similarly comprises a container body 31 having an evaporator portion 31A, a heat insulating portion 31B and a condenser portion 31C as arranged from one end of the body toward the other end thereof, and an upward projecting portion 32. The modification differs from the container of FIGS. 1 and 2 in that the container body 31 is made integrally with the projecting portion 32, which has no inside partition wall.

Figure 4:
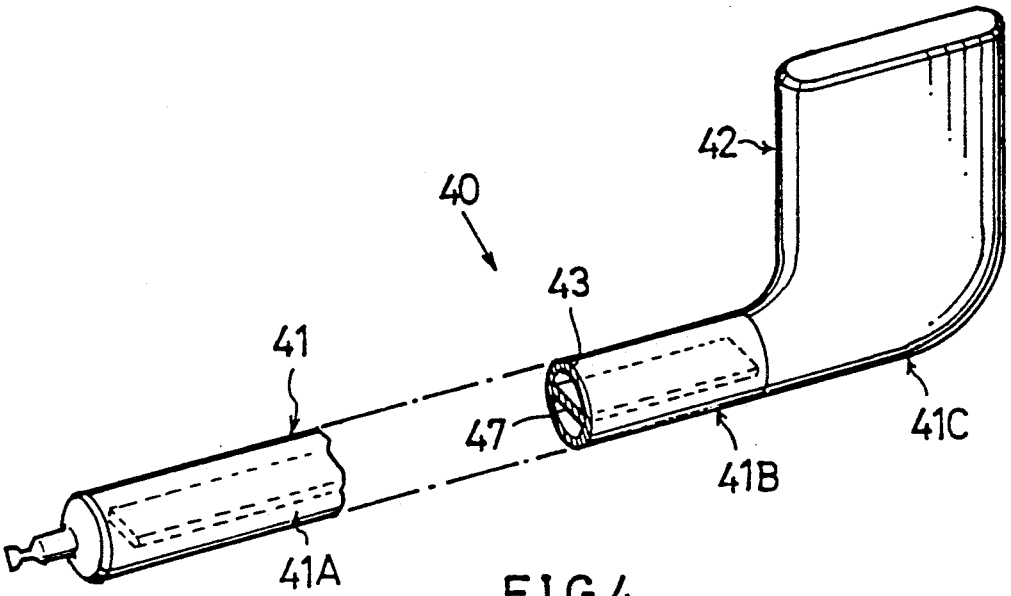

FIG. 4 shows another modified container 40, which also comprises a container body 41 having an evaporator portion 41A, a heat insulating portion 41B and a condenser portion 41C which are arranged from one end of the body toward the other end thereof, and an upward projecting portion 42. Although the container 40 closely resembles the modification of FIG. 3, the container differs therefrom in that the evaporator portion 41A and the heat insulating portion 41B of the container body 41 have a peripheral wall 43 of circular cross section, with a partition 47 provided only at these portions.

Figure 5:
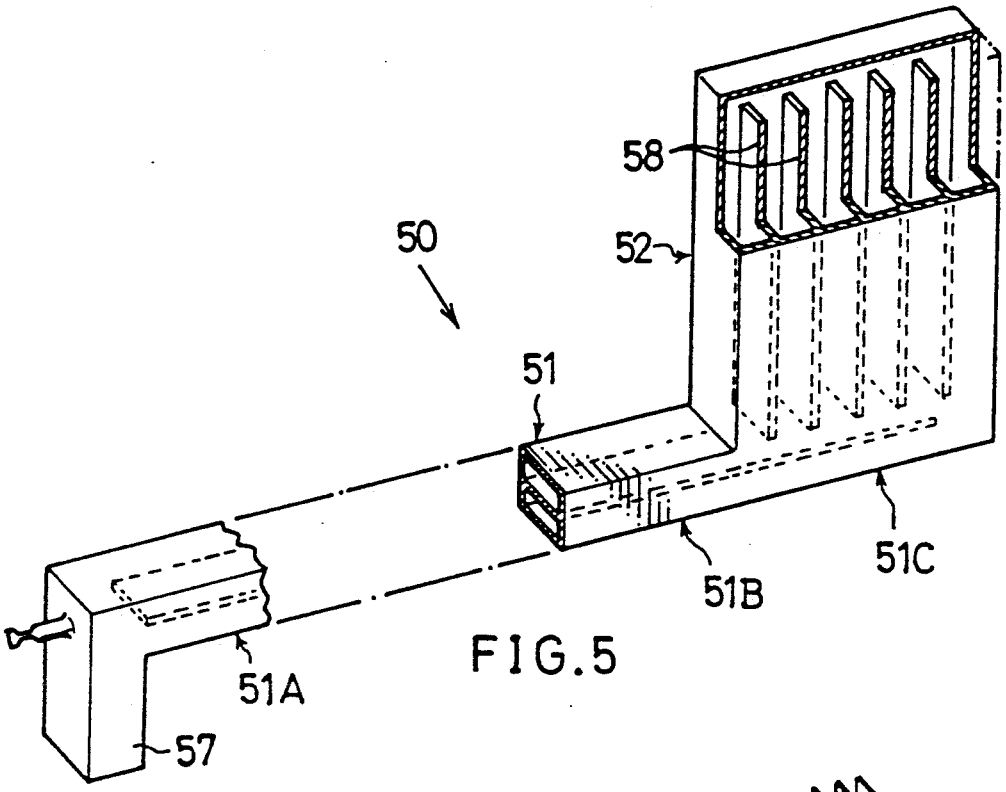

FIG. 5 shows another modified container 50, which also comprises a container body 51 having an evaporator portion 51A, a heat insulating portion 51B and a condenser portion 51C as arranged from one end of the body toward the other end thereof, and an upward projecting portion. Although closely resembling the modification of FIG. 3, the container 50 differs therefrom in that the evaporator portion 51A has a working fluid reservoir 57 communicating therewith and in the form of a downward projection, and in that the projecting portion 52 has partition walls 58.

Figure 6:
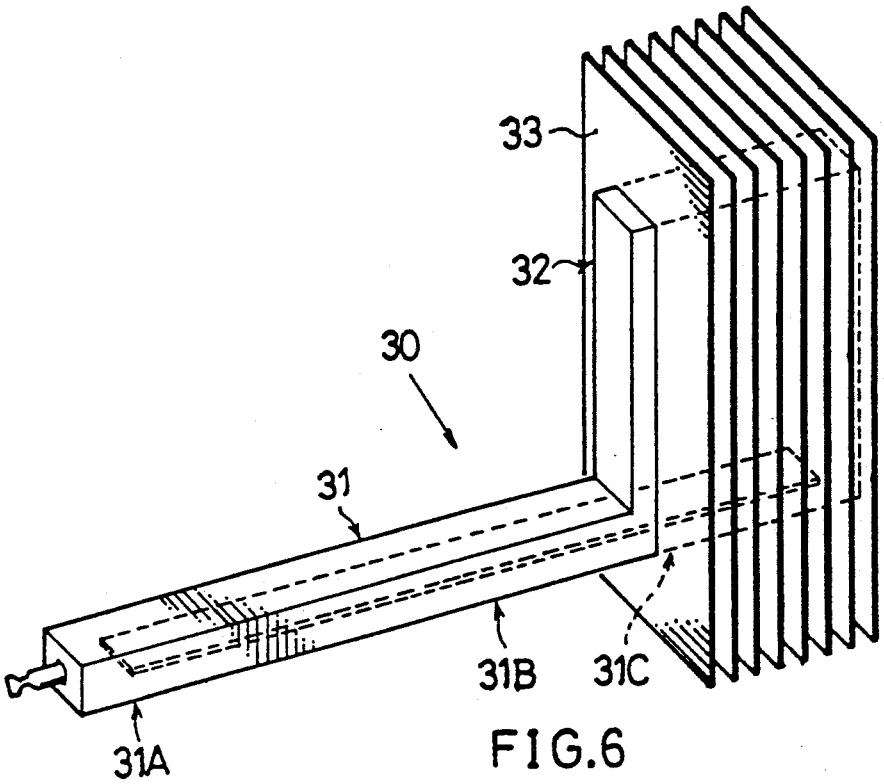
Figure 7:
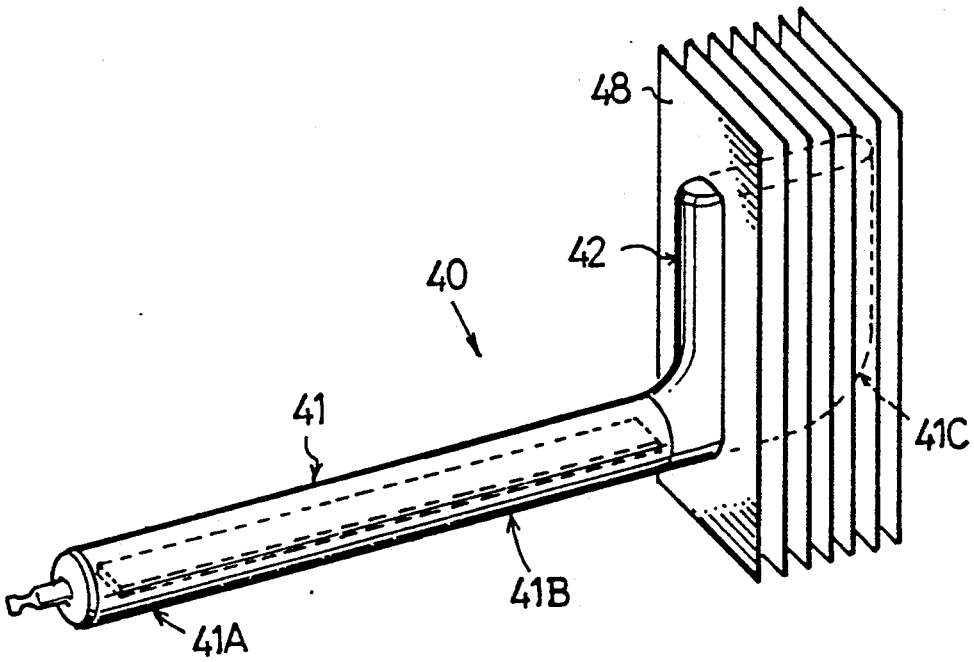
Figure 8:
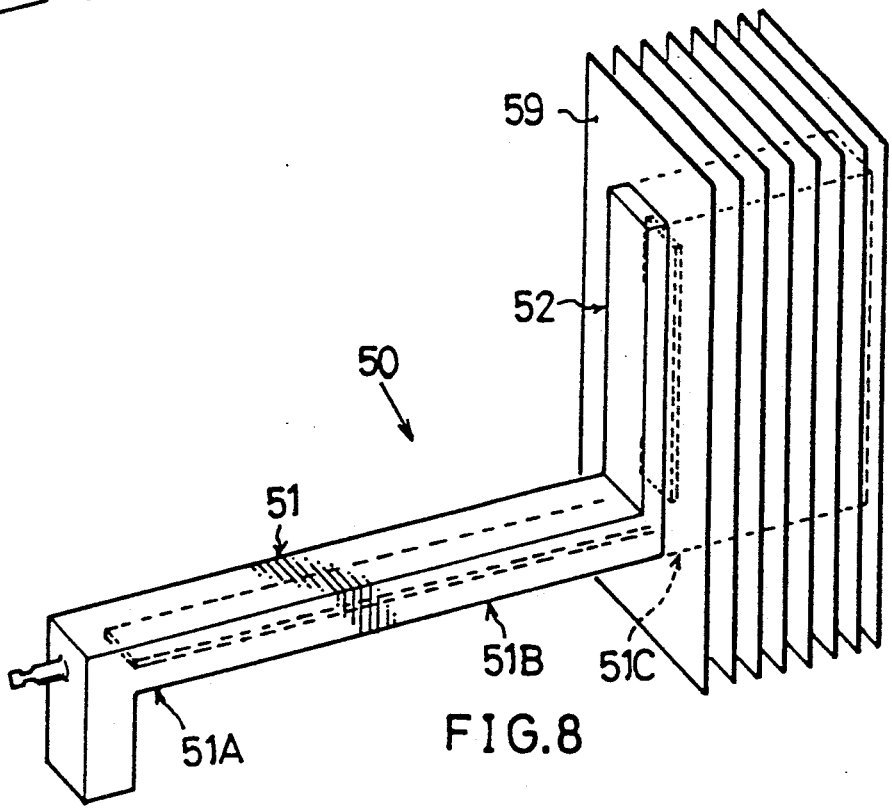

FIGS. 6 to 8 show modifications of the containers shown in FIGS. 3 to 5, respectively. Throughout FIGS. 3 to 8, like parts are referred to by like reference numerals or symbols and will not be described again in detail. FIG. 6 shows a container which corresponds to the container 30 of FIG. 3 wherein the container body is externally provided with vertical plate fins 33 arranged in parallel on the condenser portion 31C to the projecting portion 32. FIG. 7 shows a container corresponding to the container 40 shown in FIG. 4 and provided with fins 48 the same as above. FIG. 8 shows a container corresponding to the container 50 of FIG. 5 which is provided with fins 59 the same as the fins 33.

Heat pipes of the invention were tested for performance in comparison with conventional heat pipes. The results achieved will be described below with reference to FIGS. 31 to 34.

FIG. 31 shows a heat pipe S1 which is of the same type as the one shown in FIG. 3. The heat pipe S1 measures 600 mm in overall length l, 400 mm in the length l1 of the evaporator portion, 100 mm in the length l2 of the condenser portion, 17 mm in the height h of peripheral wall of the container body, 8 mm in the width w of the wall, 50 mm in the height h1 of combination of the condenser portion and the projecting portion, and 8 mm in the width w1 of the projecting portion which is equal to the width w of the condenser portion. Freon-11 was used as the working fluid. The heat pipe was installed at an angle of within ±1.5 degrees with the horizontal, an amount of heat Q1 of 30 W was given to the evaporator portion, and the temperature difference between opposite ends P1 and P2 of the evaporator portion was measured. The difference was 10° C. FIG. 32 shows a conventional heat pipe S2 of the straight tubular type corresponding to the heat pipe of FIG. 31. It was attempted to give an amount of heat Q2 to the evaporator portion of the conventional heat pipe S2 so as to produce a temperature difference of 10° C. between opposite pipe ends P3, P4, whereas the amount of heat Q2 was unmeasurable value almost approximate to zero, and the temperature difference between the ends P3, P4 was over 10° C. This means that the conventional heat pipe S2 remains almost out of operation when installed at an angle of ±1.5 degrees.

FIG. 33 shows a heat pipe S3 corresponding to the heat pipe S1 which is shown in FIG. 31 and which is further provided with fins on the condenser portion and the projecting portion. The fins are 80 mm in height H and 20 mm in width W. An amount of heat Q3 of 150 W was given to the evaporator portion with air applied to the fins at a velocity of 2 m/sec at 35° C., and the temperature difference between opposite ends P5, P6 of the evaporator portion was measured. The difference was 10° C. FIG. 34 shows a conventional heat pipe S4 of the finned straight tubular type corresponding to the heat pipe S3 of FIG. 33. When the conventional heat pipe S4 was merely given an amount of heat Q4 of 30 W at its evaporator portion, the temperature difference measured between opposite ends P7, P8 of the evaporator portion was 30° C.

The results of the two examples of comparative tests reveal that the heat pipe of the invention is exceedingly greater than the conventional heat pipe in the amount of heat transport.

Embodiment 2

FIGS. 9 to 17 show heat pipes according to a second embodiment of the invention.

Figure 9:
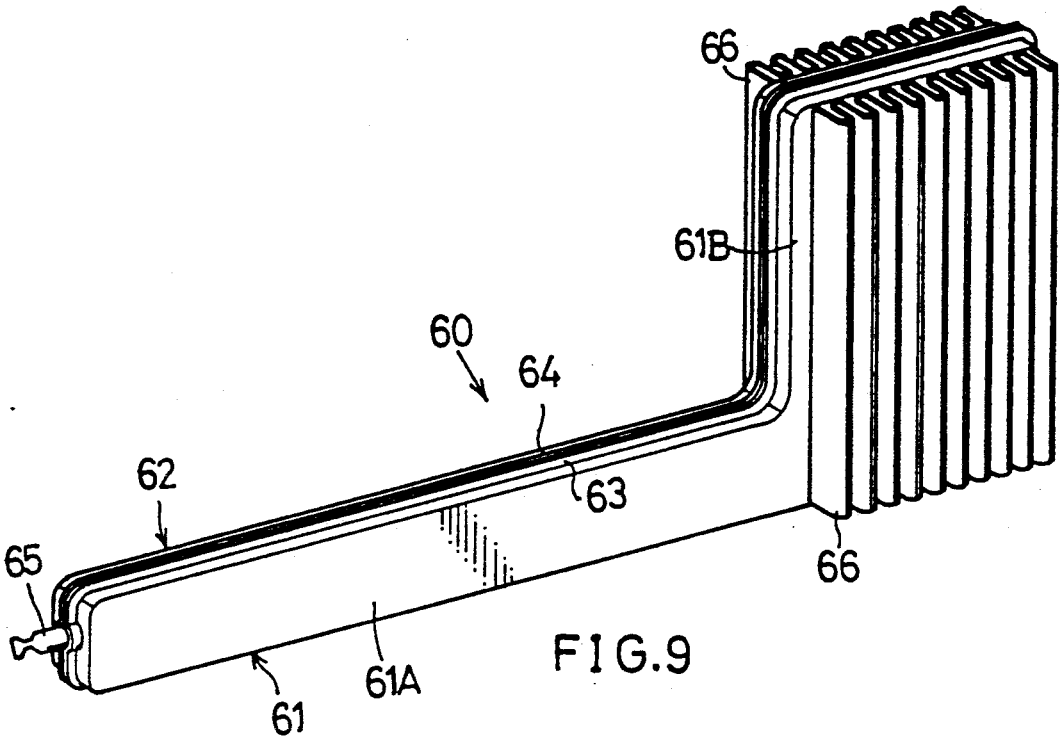
FIGS. 9 to 17 show heat pipes according to a second embodiment of the invention.

With reference to FIG. 9, the heat pipe has an L-shaped container 60 which has an unillustrated working fluid enclosed therein.

Figure 10:
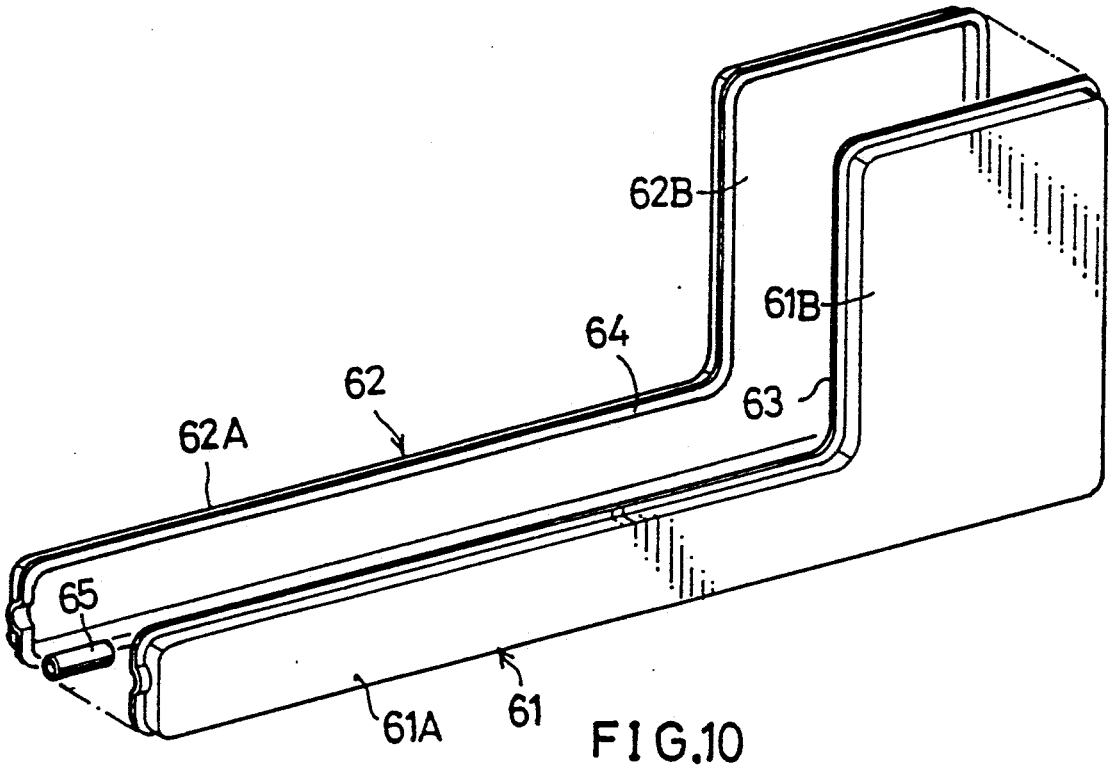

With reference to FIG. 10, the container 60 is formed by two plates 61, 62 each bulging away from the other and each made of an aluminum brazing sheet. The plates 61, 62 are L-shaped when seen from one side and respectively have horizontal portions 61A, 62A to be made into the body of the container, and vertical portions 61B, 62B to be made into a projecting portion. The plates 61, 62 are flanged as at 63, 64, respectively, along the periphery. The plates 61, 62 are so arranged that the flanges 63, 64 are fitted to each other, and are joined together at the flanges 63, 64 by brazing. A working fluid injection tube 65 is held between the outer ends of the horizontal portions 61A, 62A of the plates 61, 62. A vertical corrugated fin 66 is brazed, at the ridge or furrow portions on one side thereof, to the outer surface of each of the vertical portions 61B, 62B of the plates 61, 62.

Next, two modifications of the container 60 will be described with reference to FIGS. 11 to 15. These two modifications resemble the container of FIG. 9 closely, so that throughout the drawings concerned, like parts are designated by like reference numerals or symbols for a brief description.

Figure 11:
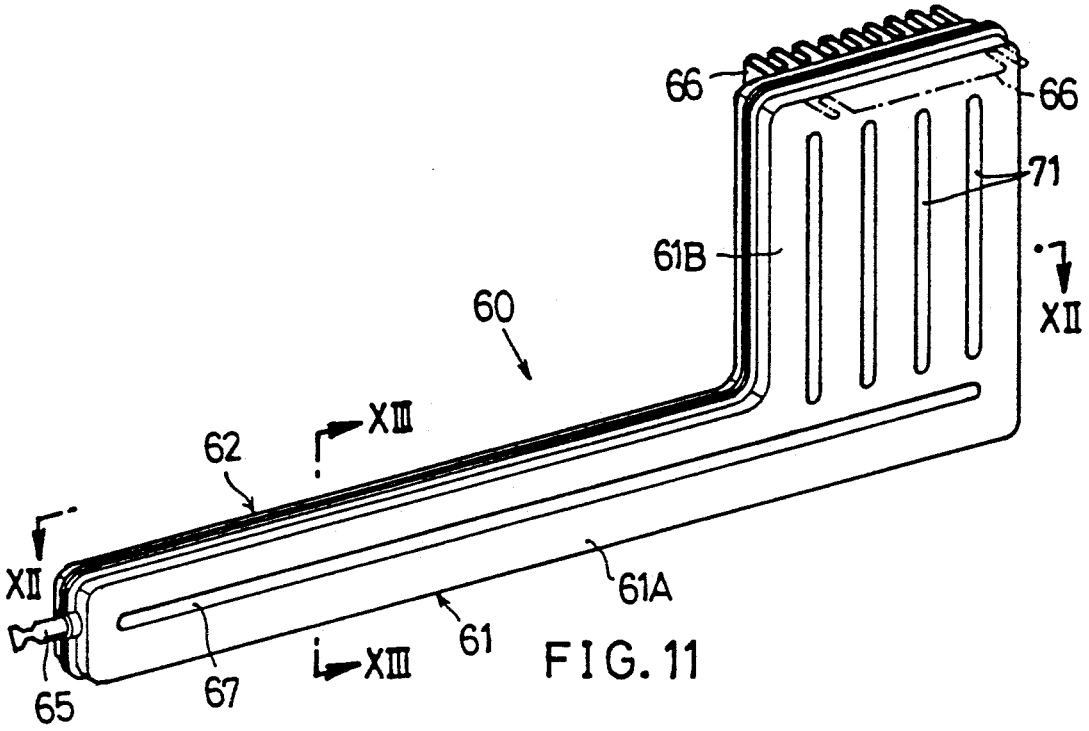
Figure 12:
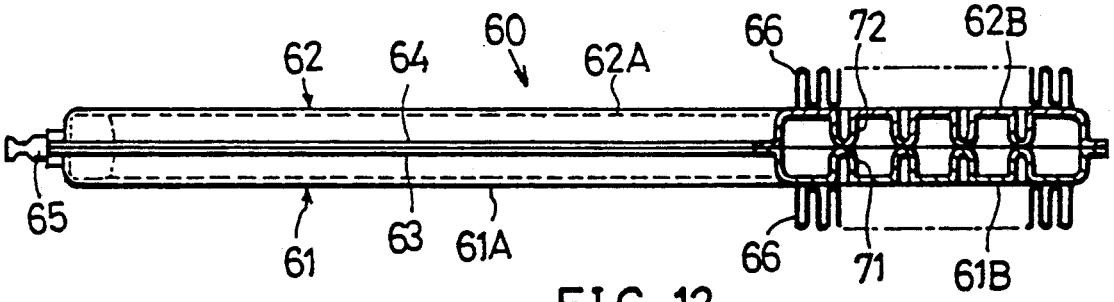
Figure 13:
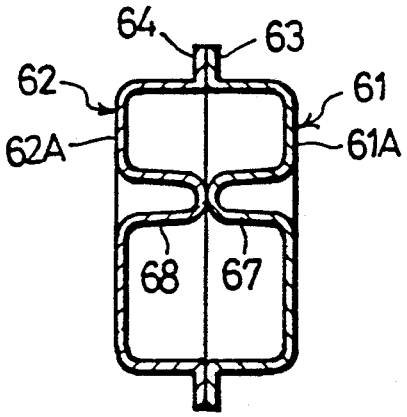

The horizontal portions 61A, 62A of plates 61, 62 of the container 60 shown in FIGS. 11 to 13 are respectively formed with horizontal beads 67, 68 inwardly protruding, having a U-shaped cross section, and opposed to and butting on each other, whereby a looped path is formed as in the case of the first embodiment for allowing the working fluid to smoothly flow therethrough. The plates 61, 62 have vertical portions 61B, 62B each formed with a plurality of inwardly protruding beads 71 or 72 U-shaped in cross section. The beads of one of the plates are opposed to and butt on the beads of the other plate in pairs to form vertical parallel passages.

Figure 14:
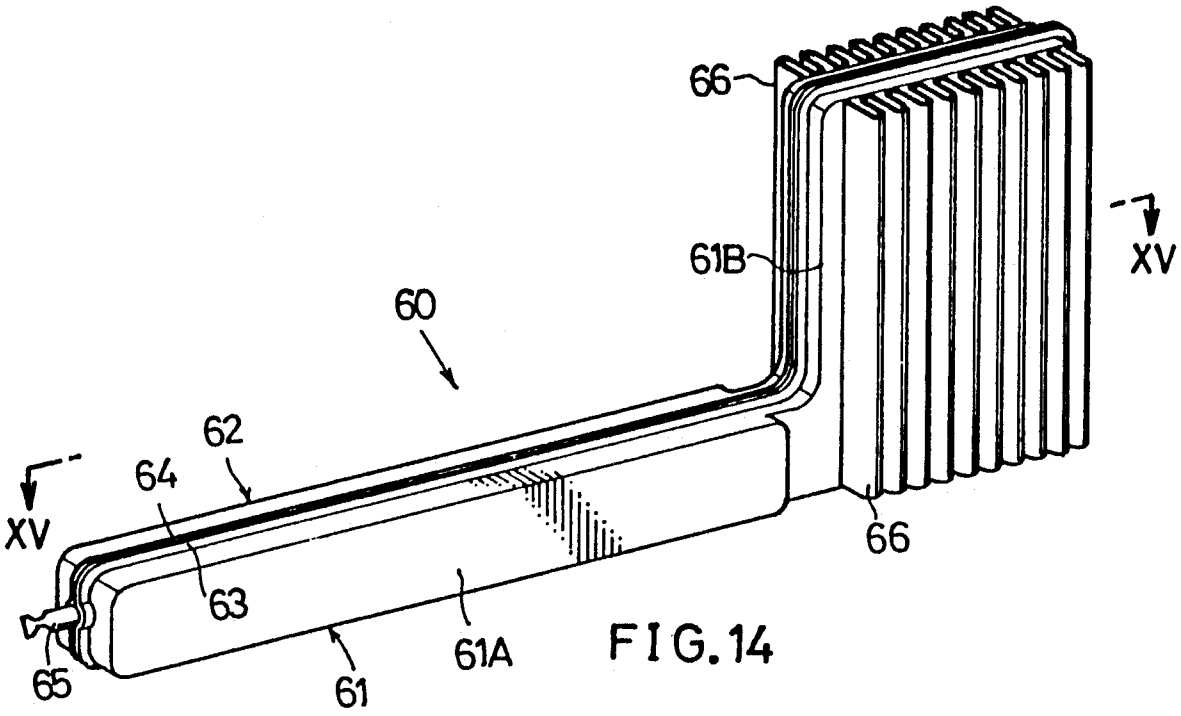
Figure 15:
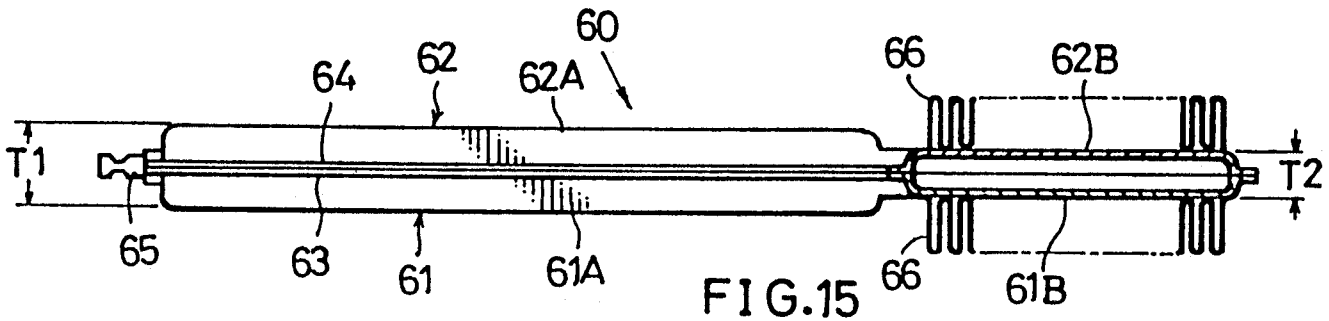

The horizontal portions 61A, 62A of plates 61, 62 of the container 60 shown in FIGS. 14 and 15 provide an evaporator portion and a heat insulating portion, where the horizontal portions have a width across flat T1 which is larger than the width across flat T2 of the condenser parts of the horizontal portions 61A, 62A and of vertical portions 61B, 62B.

Figure 17:
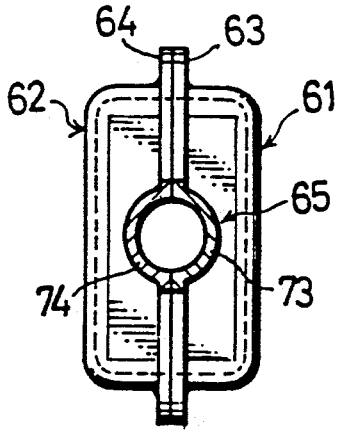
Figure 16:
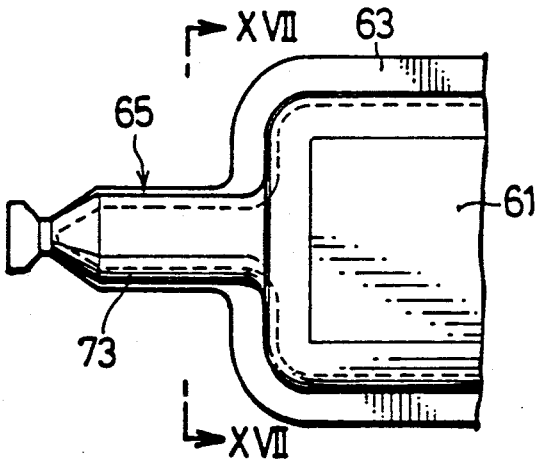

According to the second embodiment, a tubular member separate from the joined plates 61, 62 is held between the plates 61, 62 to provide the injection tube 65. As seen in FIGS. 16 and 17, however, half tube segments 73, 74 for forming a tube when joined together may be formed integrally with the respective plates 61, 62, such that the half tube segments 73, 74 are joined together into the injection tube 65 when the plates 61, 62 are joined together.

Embodiment 3

FIGS. 18 to 25 show heat pipes according to a third embodiment.

The heat pipes according to the third embodiment comprise an L-shaped container 80 like the second embodiment. The container 80 is formed by a bulged plate 81 and a flat plate 82. As is the case with the second embodiment, the plates 81, 82 respectively have horizontal portions 81A, 82A and vertical portions 81B, 82B. The bulged plate 81 is made of a brazing sheet as in the second embodiment, while the other plate 82 which is flat is made of an extrudate. The bulged plate 81 has a flange 83 which is fitted and brazed to the peripheral portion of the other plate 82. The flat plate 82 has an inwardly projecting wall 84 at the middle of height of its horizontal portion 82A, whereby a looped path is formed inside the container 80. A corrugated plate 85 is interposed between the inner surfaces of the vertical portions 81B, 82B of the plates 81, 82 to thereby form vertical parallel passages between the vertical portions 81B, 82B. A corrugated fin 86 is joined to the outer surface of each plate vertical portion 81B or 82B. A working fluid injection tube 87 is held between the outer ends of the horizontal portions 81A, 82A of the plates 81, 82. As seen in detail in FIG. 21, the injection tube 87 is in the form of partly collapsed circle in cross section.

Figure 23:
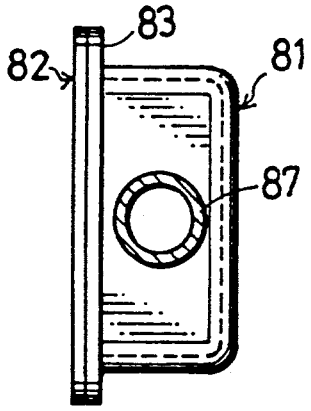
FIGS. 18 to 25 show heat pipes according to a third embodiment of the invention.
Figure 22:
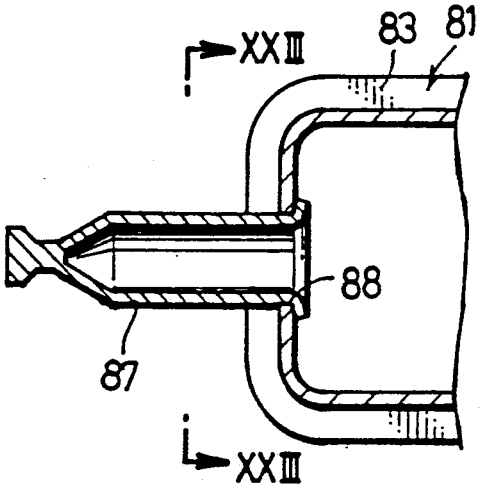
Figure 25:
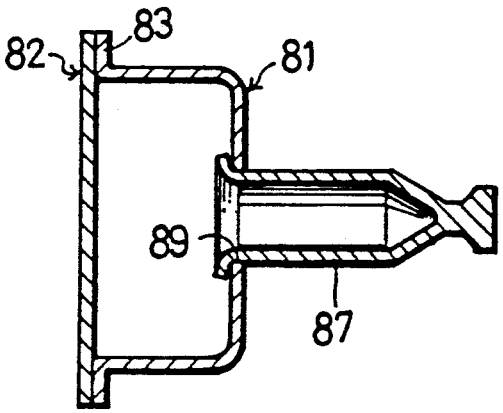
Figure 24:
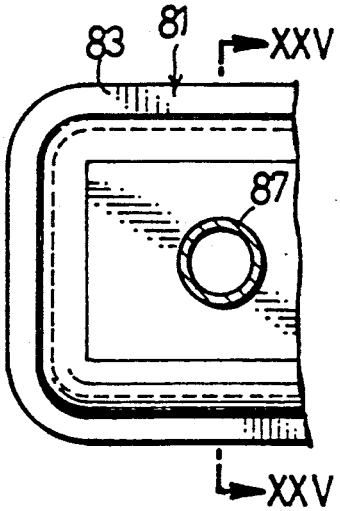
Figure 18:
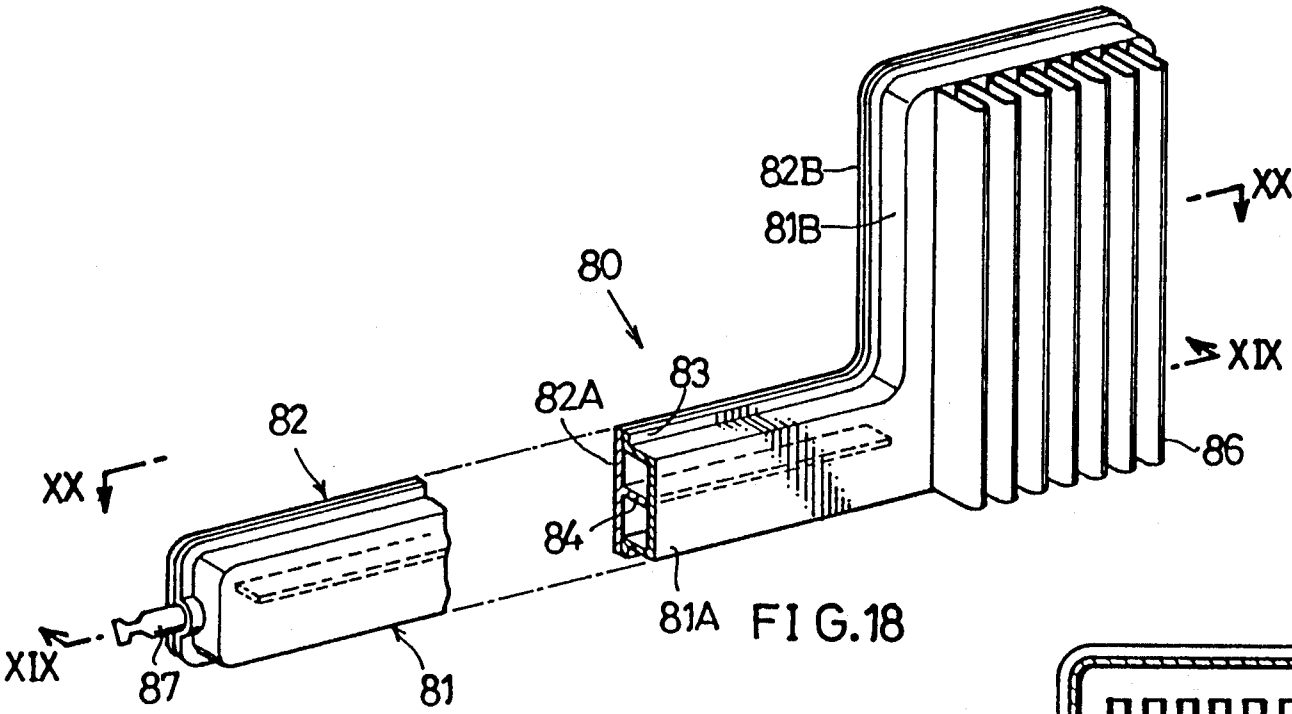
Figure 19:
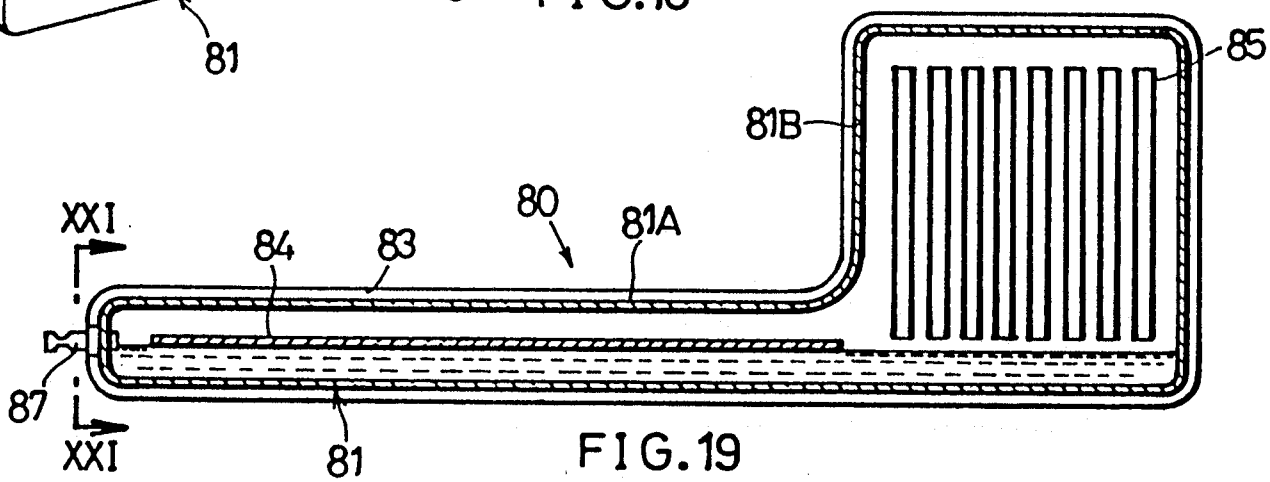
Figure 20:
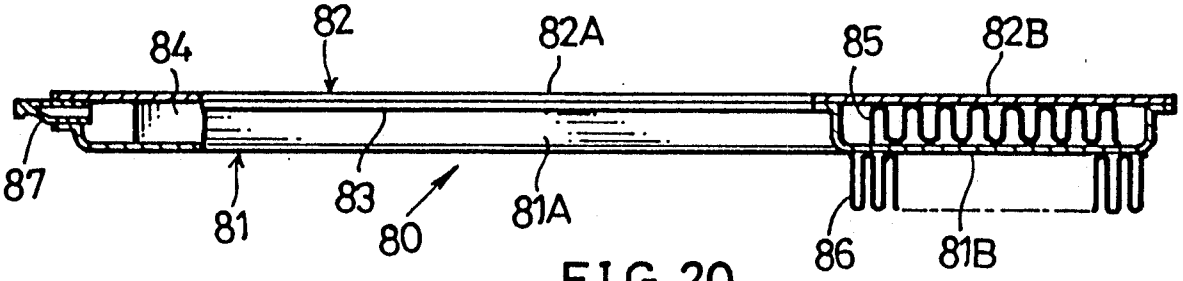
Figure 21:
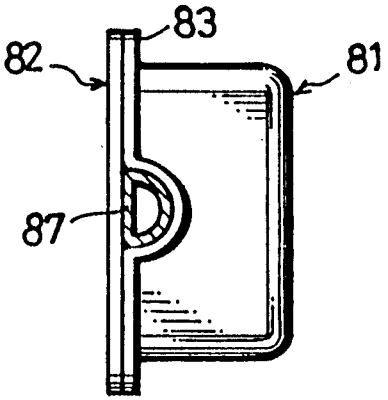

The injection tube 87 of the third embodiment, which is formed in the same manner as in the second embodiment, may alternatively be provided by forming an insertion hole 88 in the end of the bulged plate 81 and mechanically crimping the injection tube 87 to the hole-defining edge portion as seen in FIGS. 22 and 23. Further as shown in FIGS. 24 and 25, an insertion hole 89 may alternatively be formed in a side portion of the bulged plate 81.

Embodiment 4

FIGS. 26 to 30 show another heat pipe as a fourth embodiment of the invention.

Figure 26:
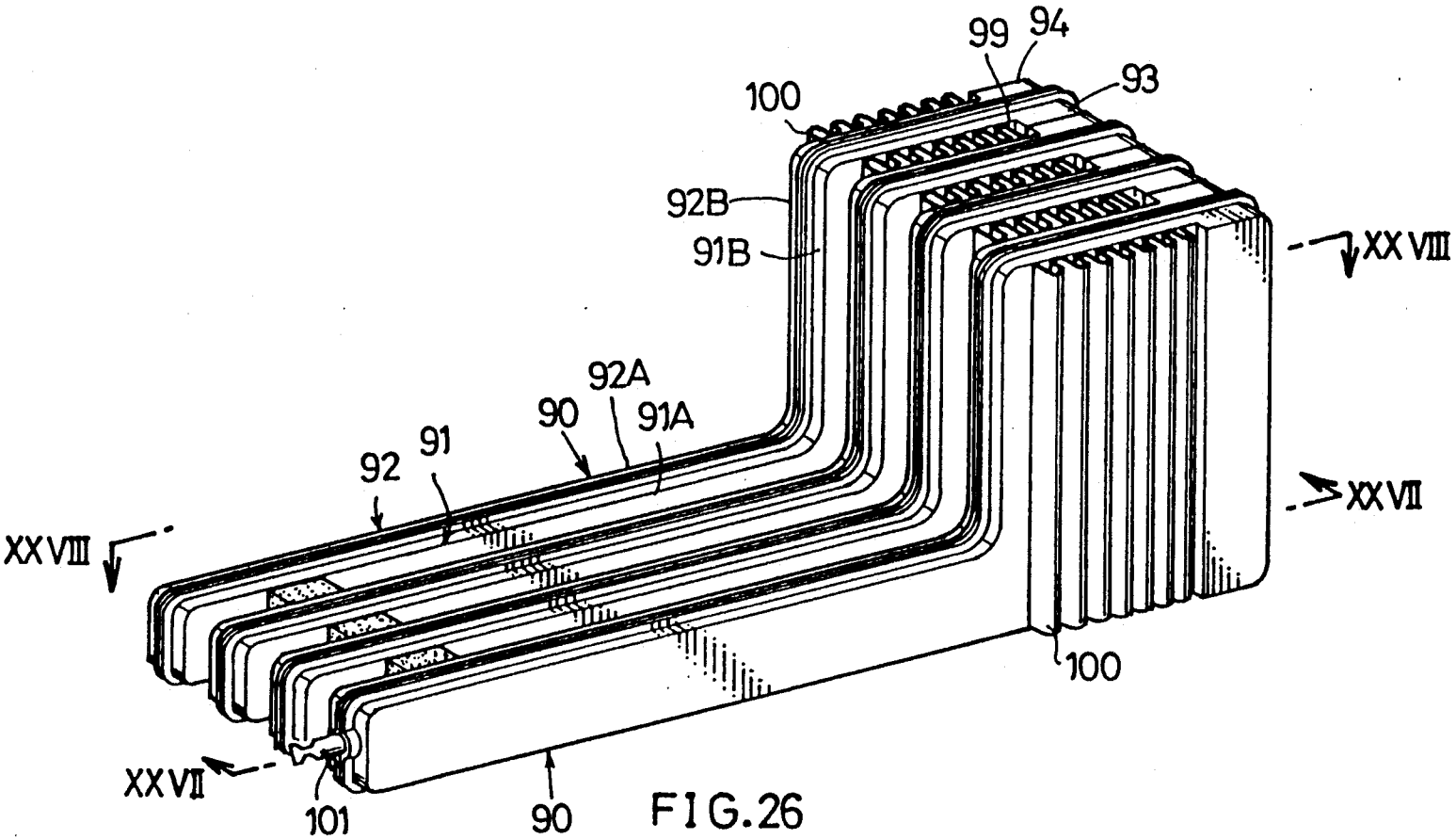
FIGS. 26 to 30 show a heat pipe according to a fourth embodiment of the invention.
Figure 27:
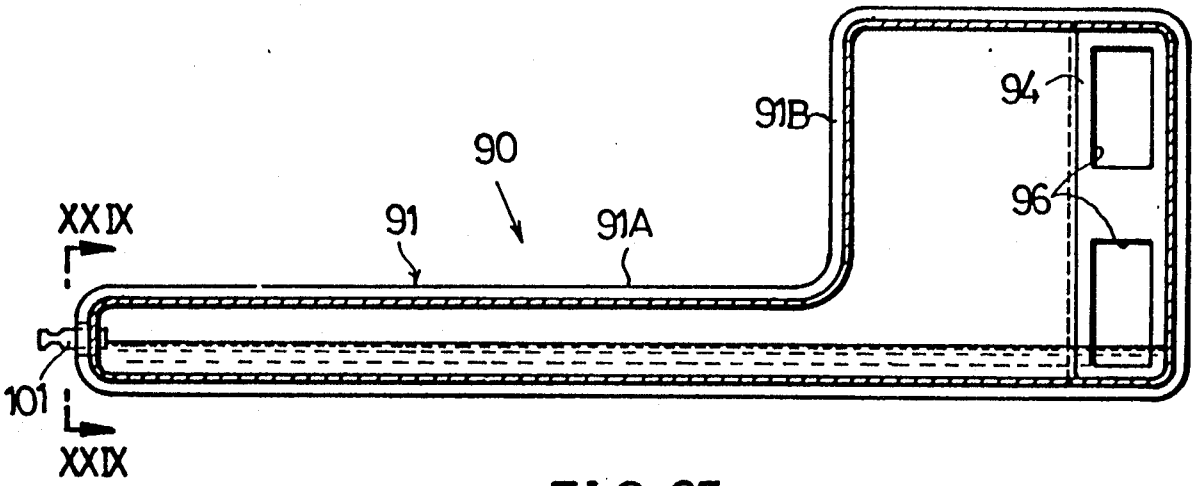
Figure 28:
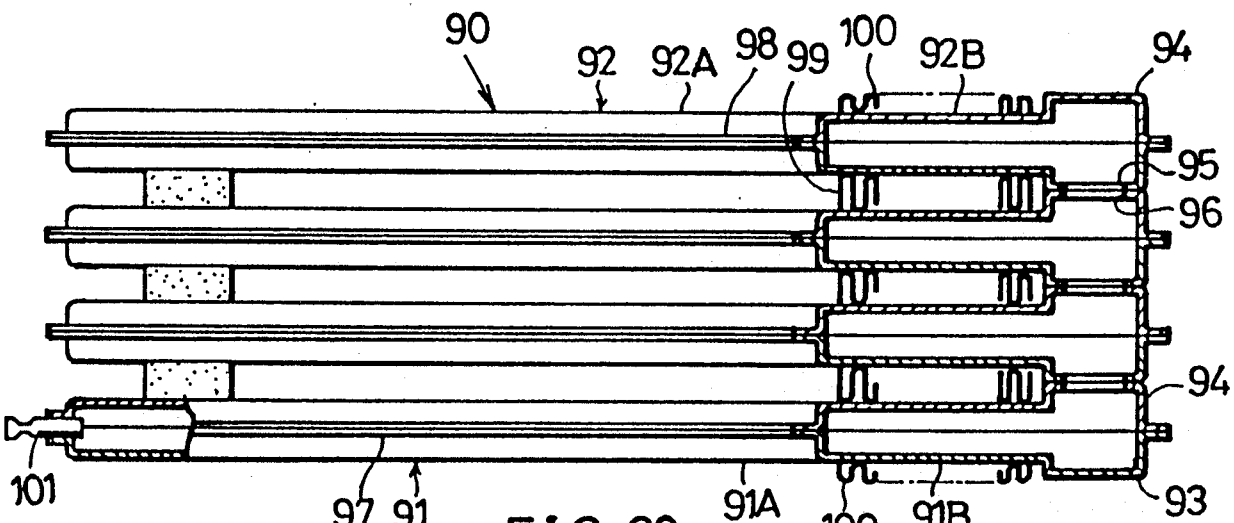
Figures 29, 30:
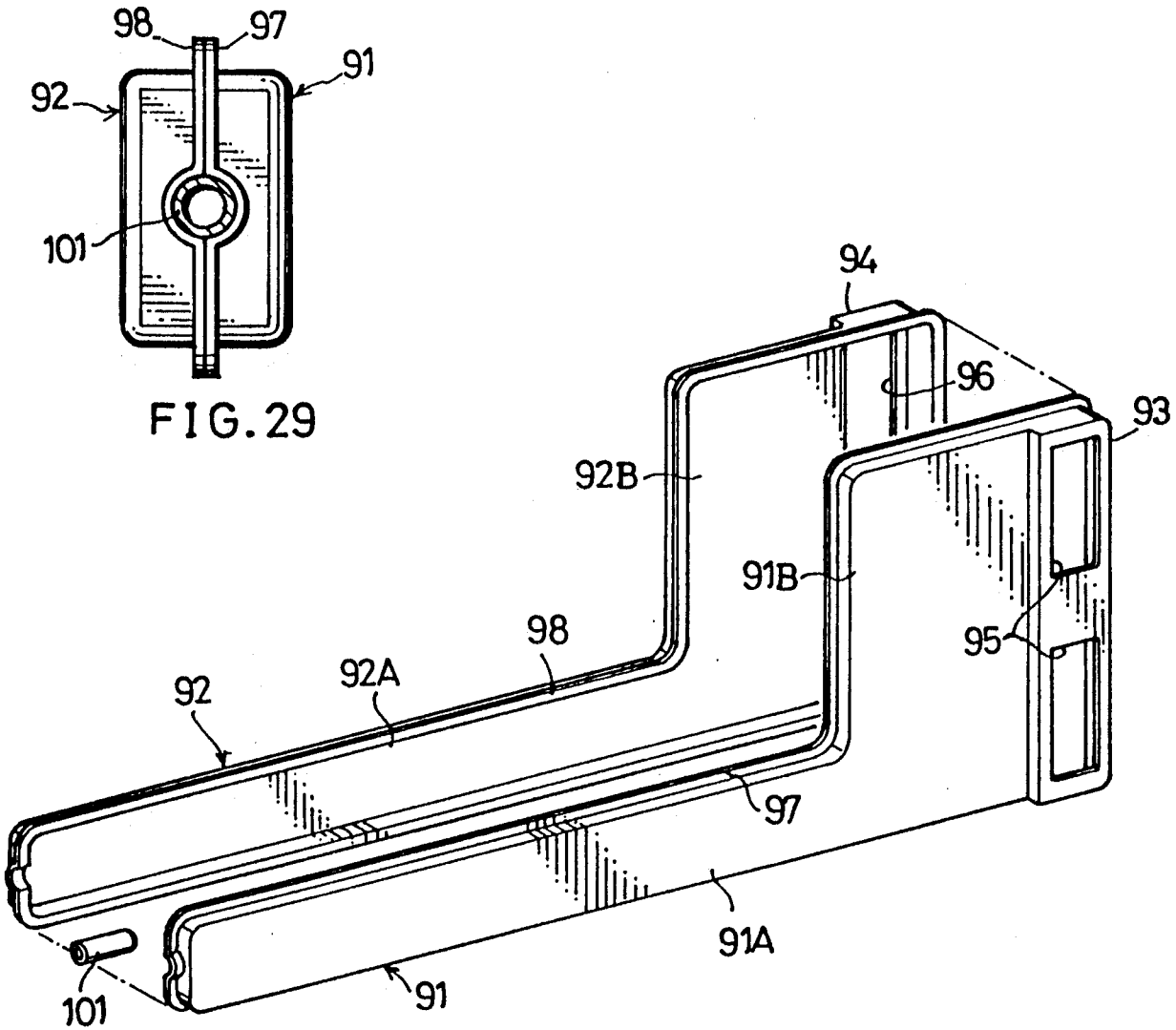
Figure 35:
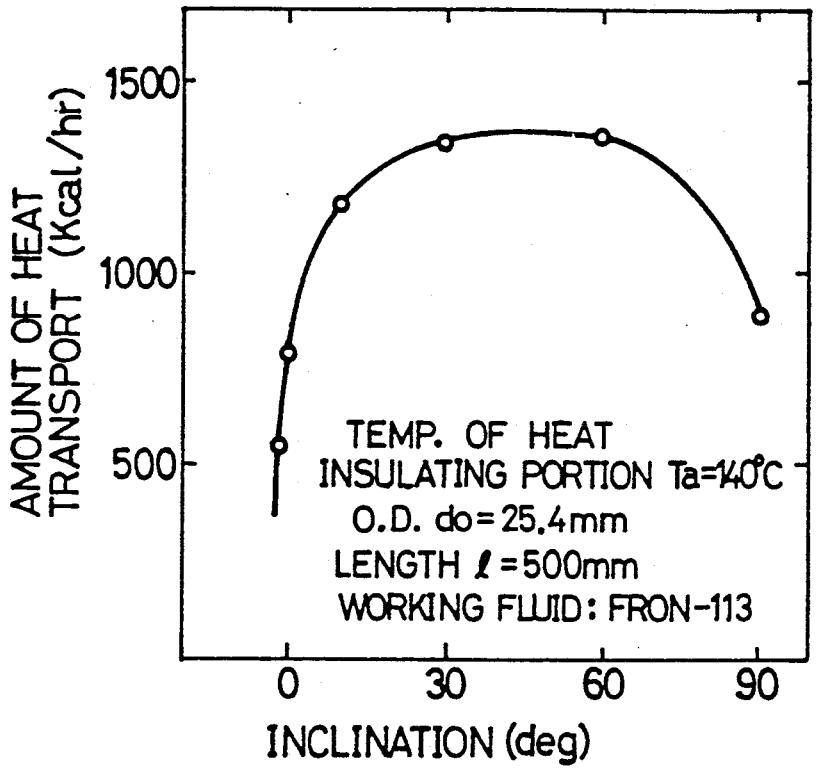
FIGS. 35 to 37 are graphs showing the usual performance of conventional heat pipes.
Figure 36:
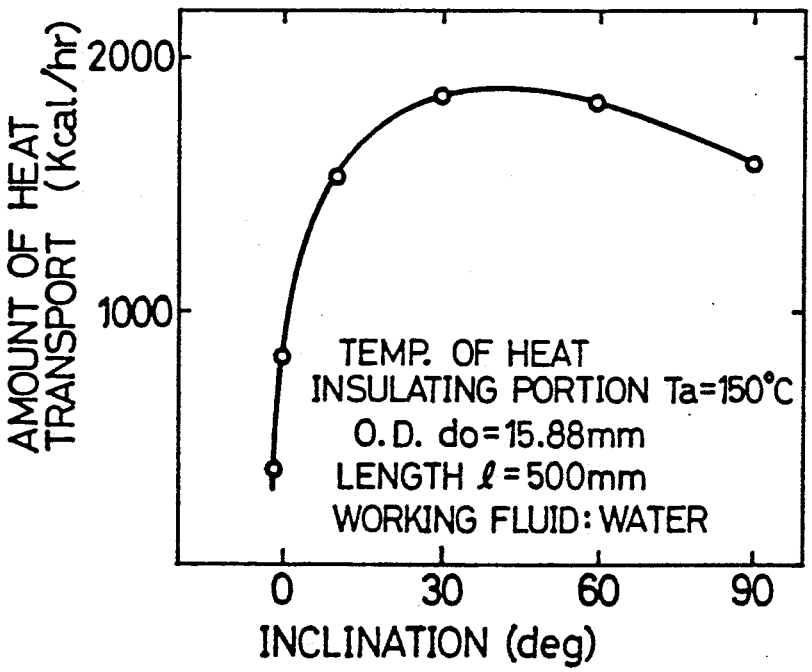
Figure 37:
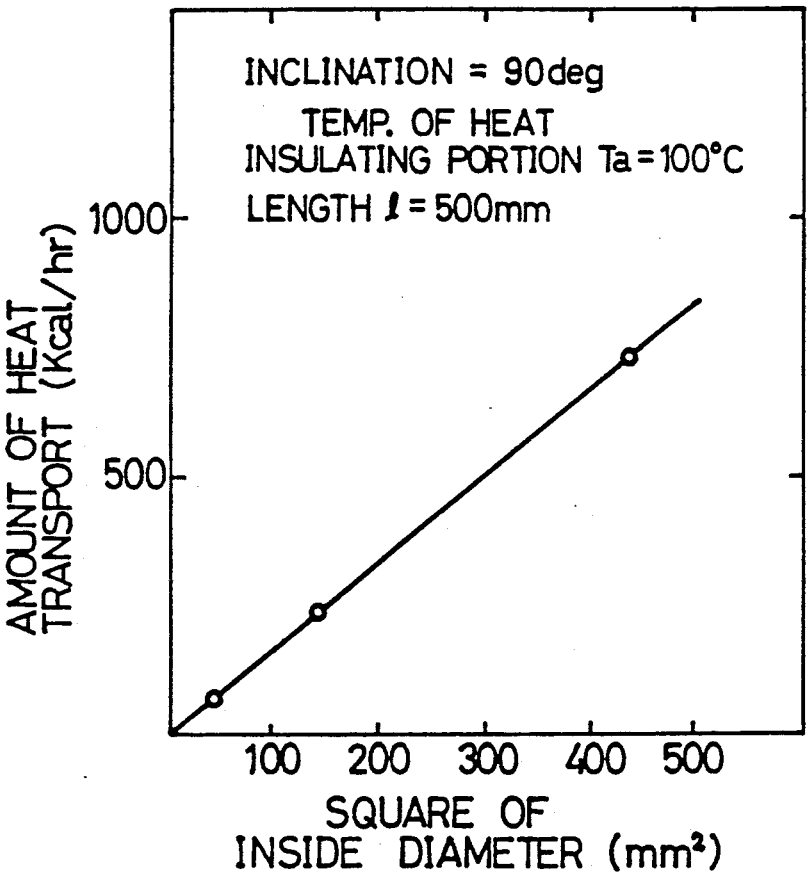

The heat pipe has four containers 90 arranged side by side. As seen in FIG. 30, each of the containers 90 is formed by two plates 91, 92 joined together and each bulging away from the other. These plates 91, 92 closely resemble those of the second embodiment shown in FIG. 10 and respectively have horizontal portions 91A, 92A, and vertical portions 91B, 92B. However, they differ from those of the second embodiment in that the vertical portions 91B, 92B are formed at their outer ends with communicating parts 93, 94 projecting sidewise, and in that each of these parts 93, 94 is formed with two communicating openings 95 or 96 as arranged one above the other. As shown in FIG. 26, the foremost plate 91 and the rearmost plate 92 have no communicating opening. The plates 91, 92 forming each container 90, like the plates 61, 62 shown in FIG. 10, are so arranged that flanges 97, 98 are fitted and brazed to each other. The communicating part 93 of each container 90 is brazed to the communicating part 94 of another container 90 adjacent thereto at the edges around the openings 95, 96, whereby the vertical portions 91B, 92B including the communicating parts 93, 94 are adapted to provide a continuous header tank. Further a corrugated fin 99 is interposed between the plate vertical portions 91B, 92B of the adjacent containers 90, at the position where the communicating parts 93, 94 are not formed. With reference to FIG. 26, a corrugated fin 100 is provided on the outer side surface of the vertical portion 91B or 92B of each of the foremost plate 91 and the rearmost plate 92, at over the area thereof where the communicating part 93 or 94 is not formed. As seen in FIG. 26, a working fluid injection tube 101 is held between the outer ends of horizontal portions 91A, 92A of the plates 91, 92 of the foremost container 90.

What is claimed is:

1. A heat pipe container having a working fluid enclosed therein, the container comprising:

a container body in the form of a horizontal straight tube and having an evaporator portion, a heat insulating portion and a condenser portion as arranged from one end of the body to the other end thereof; and an upward hollow projecting portion provided on the condenser portion of said container body, said container body and said projecting portion being formed by two plates joined together and each bulging away from the other, each of the plates being L-shaped when seen from one side and having a horizontal portion forming said container body and a vertical portion forming said projecting portions.

2. A heat pipe container as defined in claim 1 wherein the horizontal portion of each of the plates has an inwardly protruding bead U-shaped in cross section, the beads of the plates being opposed to and butting on each other to form a horizontal partition.

3. A heat pipe container as defined in claim 1 wherein the vertical portion of each of the plates has a plurality of inwardly protruding beads U-shaped in cross section, the beads of one of the plates being opposed to and butting on the beads of the other plate in pairs to form vertical parallel partition walls.

4. A heat pipe container as defined in claim 1 wherein a corrugated fin is joined to the outer surface of the vertical portion of each plate.

* * * * *